US006029366A

United States Patent [19]

Poirier et al.

[11] Patent Number: 6,029,366

[45] Date of Patent: Feb. 29, 2000

[54] APPARATUS FOR COOLING OR DRYING BULK MATERIAL

[75] Inventors: Daniel J. Poirier, Raleigh; Brian D. Hinkle, Apex, both of N.C.; Joseph M. DeWane, Windham, N.H.

[73] Assignee: Aeroglide Corporation, Raleigh, N.C.

[21] Appl. No.: 09/252,943

[22] Filed: Feb. 18, 1999

Related U.S. Application Data

[62] Division of application No. 08/966,283, Nov. 7, 1997.

[51] Int. Cl.[7] ..... F26B 17/12

[52] U.S. Cl. ..... 34/166; 34/171

[58] Field of Search ..... 34/165, 166, 167, 34/168, 170, 171, 172, 173

[56] References Cited

U.S. PATENT DOCUMENTS

| | | | |
|---|---|---|---|
| 3,701,203 | 10/1972 | Anderson | 34/170 |
| 3,727,323 | 4/1973 | Meiners et al. | 34/170 |
| 3,824,705 | 7/1974 | Ives | 34/170 |
| 4,264,415 | 4/1981 | Galow et al. | 34/174 X |
| 5,701,683 | 12/1997 | Wilhelm | 34/435 X |
| 5,709,035 | 1/1998 | Wilhelm | 34/167 |
| 5,860,221 | 1/1999 | Morrison et al. | 34/167 |

*Primary Examiner*—Henry Bennett
*Assistant Examiner*—Steve Gravini
*Attorney, Agent, or Firm*—Coats & Bennett, P.L.L.C.

[57] ABSTRACT

The bulk material cooler/dryer apparatus of the present invention utilizes an oscillating spreader assembly in conjunction with a reciprocating discharge grate structure to achieve uniform distribution of in-flowing bulk material within a main processing chamber and also to achieve uniform and efficient discharge of the material from the chamber once processing is complete. This uniform distribution of bulk material within the processing chamber is accomplished via a spreader assembly which is mounted to the top of the chamber and which moves along two orthogonal axes. Motion with respect to each of the axes is facilitated by a pair of linear actuators, the actions of which are controlled so as to cause the stream of in-flowing material that is issued therefrom to oscillate in a sinusoidal type pattern when observed from a point above the spreader assembly. The result of such oscillation of the spreader assembly and the material issuing therefrom is the generally uniform distribution of the material within the processing chamber. The material falls through the chamber and is processed, eventually reaching the lower boundary of the chamber about which is disposed the reciprocating discharge assembly.

33 Claims, 9 Drawing Sheets

APPARATUS FOR COOLING OR DRYING BULK MATERIAL

CROSS-REFERENCE TO RELATED APPLICATION

This is a divisional patent application of U.S. patent application Ser. No. 08/966,283, filed Nov. 7, 1997.

FIELD OF THE INVENTION

The present invention relates to an apparatus for cooling or drying bulk material, and more particularly to a cooling or drying apparatus which achieves a generally uniform spreading of bulk material within a main cooling/drying chamber and furthermore facilitates the continuous and generally uniform discharge of the bulk material from the chamber once the cooling or drying process is complete.

BACKGROUND OF THE INVENTION

It is a common requirement of numerous bulk material processes to cool or dry the product at some intermediate or final stage of production. As implied by the name, the product to be cooled or dried is typically produced in bulk quantities and consequently requires a cooling or drying apparatus that is capable of processing large quantities of material in an efficient, continuous and uniform manner. Typical bulk material cooler/dryer designs achieve the desired cooling or drying effect by forcefully flowing a gas, such as air, through the cooling/drying chamber and consequently through the bulk material that is contained therein. If a general cooling effect is desired, cool air is forced through the chamber, whereas if a drying effect is desired, warm or hot air is necessarily flowed through the chamber.

Given a cooling/drying air stream of constant temperature and a constant air flow rate, relatively accurate control of the bulk material flow rate through the cooling/drying chamber is required in order to maintain a constant temperature or degree of dryness of the material that is discharged from the chamber. Furthermore, in addition to the constant flow rate of bulk material through the cooling/drying chamber, it is also necessary that the bulk material be generally uniformly distributed within chamber as it flows therethrough.

It will be appreciated that under steady state conditions, control of the effective bulk material flow rate through the cooling/drying chamber can be monitored and maintained via control of the bulk material level within the main cooling/drying chamber. In basic terms, control of the bulk material level within the chamber can be accomplished by controlling both the flow rate of material into the chamber and the flow rate of material out of the chamber.

In practice, the primary difficulty involves the design of a practical bulk materials cooling/drying apparatus which provides adequate control of the outlet flow rate of material from the chamber, while simultaneously providing the degree of uniform material distribution required for efficient and effective operation of the cooling/drying apparatus. Furthermore, it is highly desirable from a maintenance perspective that the apparatus provide a simple and effective means of cleaning or emptying the cooling/drying chamber and its associated components, which typically entails a chamber outlet design which can be rapidly switched between a normal operating configuration and a clean-out configuration.

While a number of bulk materials cooling/drying chambers employing a variety of chamber inlet/outlet configurations have been disclosed in prior art submissions, such as U.S. Pat. No. 4,887,364, a cooling/drying apparatus continues to be needed which is simple in design, yet provides optimal performance with regard to the control of material distribution within the cooling/drying chamber and the associated flow rate of material therethrough. In addition, provision within the apparatus for simple and rapid clean-out of residual particulate material from the cooling/drying chamber and associated components is also a key requirement of the bulk materials manufacturing sector. Finally, it is important that the cooling/drying apparatus be provided with a material discharge assembly that handles the bulk material in such a manner that the material is not damaged.

SUMMARY OF THE INVENTION

The present invention entails a cooling/drying apparatus that is capable of uniformly and efficiently processing a continuous stream of granular type bulk materials, which is relatively simple in design and consequently can be manufactured economically. More particularly, the bulk materials cooler/dryer of the present invention employs an oscillating inlet spreader assembly in combination with a reciprocating discharge grate structure so as to achieve exceptionally uniform distribution of in-flowing bulk material within a processing chamber as well as uniform and efficient discharge of the material from the chamber once processing is completed.

In general, the bulk materials cooler/dryer of the present invention comprises a main frame structure and an associated side wall which generally form a central holding area or chamber. The upper portion of the chamber is enclosed by a top structure, while the lower portion is bounded by a discharge assembly. During normal operation, air is drawn up through the discharge assembly from an air inlet duct, flowing generally upwardly through the chamber, and ultimately exiting the chamber through exhaust ducts located in the top structure. With air flow established through the chamber, as described above, bulk material is uniformly distributed into the chamber via a bulk material inlet disposed in the top structure. Once introduced into the chamber, the bulk material falls downwardly through the chamber in a direction that is generally counter to the flow of air. Upon reaching the discharge assembly, the processed bulk material is collected and uniformly discharged to a storage receptacle or conveyor waiting below.

In a preferred embodiment, the bulk material inlet assumes the form of a bi-axial, oscillating spreader assembly. The entire spreader assembly is mounted to the top structure of the chamber and includes a pivoting cradle. Pivotally mounted within this cradle is a spout having an inlet for receiving an in-flowing stream of bulk material and an outlet for discharging the bulk material stream into the chamber. While both the cradle and the spout are pivotally mounted and free to rock or rotate about an axis, the two axes are orthogonal or normal to one another. A pair of actuators are provided so as to facilitate the movement of both the cradle and spout about their respective axes. Actuation is applied in such a manner so as to cause the spout outlet and necessarily the stream of material issuing forth from said outlet to be uniformly distributed within the chamber.

In a preferred embodiment, the discharge assembly disposed about the lower portion of the chamber is configured so as to comprise a stationary or fixed baffle assembly which is located above and adjacent a reciprocating grate structure. The baffle assembly includes a series of elongated baffle members which are formed so as to exhibit a generally inverted "V" shaped profile when viewed in cross section. The relative spacing of the baffle members is such that a series of flow-through areas are formed between adjacent baffles. The reciprocating grate structure includes a series of elongated slat members which are generally rectangular. Once again, the relative spacing of the slat members is such that a series of flow-through passageways are formed between adjacent slat members. When assembled and operational, the stationary baffles and reciprocating grate assemblies cooperate to effectively form a variable flow area interface, which can be used to control the rate of discharge of material from the chamber. Thus, as the flow-through areas of the baffle and grate assemblies are moved into alignment, the flow of material is permitted therethrough. As the respective flow-through areas are misaligned, material flow is restricted. Furthermore, as the baffle and grate assembly flow-through areas are moved into alignment, wiper assemblies which form a part of the lower portion of the baffles effectively sweep or wipe any material that has collected on top of the adjacent slats into and through the flow-through passageways. As mentioned previously, upon clearing the discharge assembly, the processed bulk material is collected and uniformly discharged to a storage receptacle or conveyor waiting below. In practice, control of the reciprocation rate, and consequently the discharge rate, is accomplished via control of a reciprocation actuator which is supported on the main frame of the cooling/drying apparatus. The discharge assembly of the present invention further includes provision to manually align the baffle and grate assemblies in such a manner so as to facilitate rapid and efficient clean-out of the chamber.

Other features and advantages of the present invention will become apparent and obvious from a study of the following description and the accompanying drawings which are merely illustrative of such invention.

DETAILED DESCRIPTION OF THE INVENTION

Figure 1:
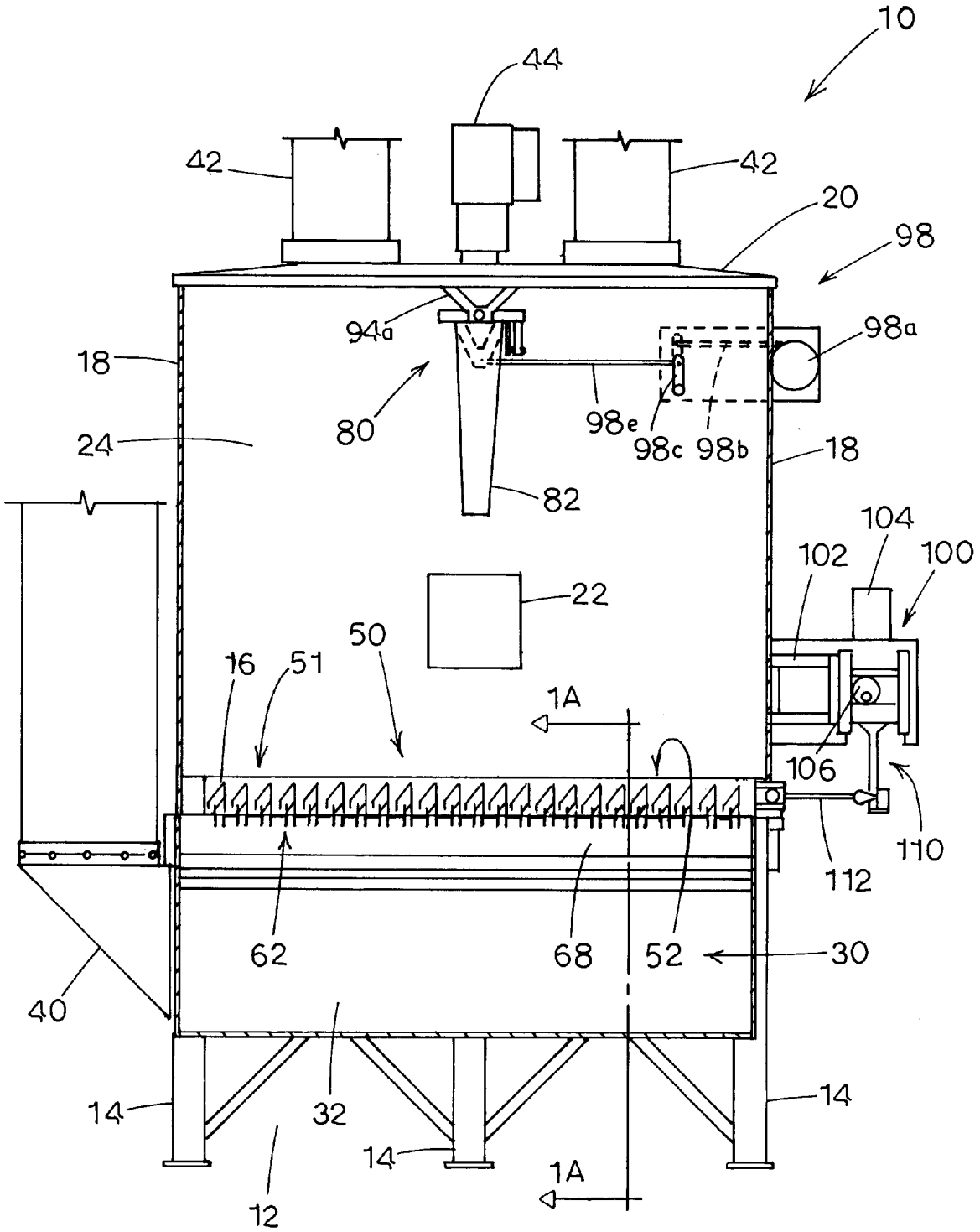
FIG. 1 is a sectional view of the bulk material cooler/dryer of the present invention, illustrating the internal structure of the cooling/drying chamber and the associated spreader and discharge assemblies.

Shown in FIG. 1 is the bulk material cooler/dryer of the present invention, indicated generally by the numeral 10. As the bulk material cooler/dryer 10 can function either in a cooling or drying capacity, depending on the functional configuration selected at the time of operation, the apparatus of the present invention disclosed and described herein will henceforth, for the most part, be referred to simply as a bulk materials cooler 10. But it will be appreciated by those skilled in the art that the apparatus 10 is equally suitable for drying many forms of materials, especially granular materials.

Bulk cooler 10 includes a mainframe assembly indicated generally by the numeral 12. The mainframe 12 comprises a plurality of supporting post members 14, about the upper end of which are generally disposed a number of opposed side frame members 16. Disposed generally above the mainframe 12 is a side wall structure 18 which in combination with a top structure 20 serves to generally surround and enclose the area above the mainframe 12, thus forming a chamber 24. Formed in side wall structure 18 is an access panel or hatch 22 which provides an entry way through the side wall 18 leading directly into the interior chamber 24.

Housed generally below the side frame structure 16 is a discharge hopper, indicated generally by the numeral 30. Discharge hopper 30 comprises a series of side panels 32 which are joined together and extend downward in a generally tapered manner forming a discharge outlet 34. (See FIG. 1A) Disposed in one of the panels 32 is an opening which serves to communicatively couple the hopper 30 to an air inlet duct 40.

Functioning in tandem with the air inlet duct 40 are a pair of air exhaust ducts 42 which are communicatively coupled to bulk cooler 10 through openings formed in the top structure 20. These exhaust ducts 42 are further coupled to a vacuum pump or blower (not shown) located external to the bulk cooler 10 which serves to induce the flow of air through the inlet duct 40, interior chamber 24 and the exhaust ducts 42. Also disposed about the top structure 20 is a rotary air lock 44, which function to feed material into the bulk cooler apparatus 10. Details of the rotary air lock 44 are not dealt with herein in detail because such devices are common and well-known in the art. Suffice it to say that the rotary air lock 44 is communicatively connected to a supply of material being fed to the cooler 10. Basically, the design of the rotary air lock prevents the air from entering through the rotary air lock 44 rather than the inlet duct 40.

Figure 7:
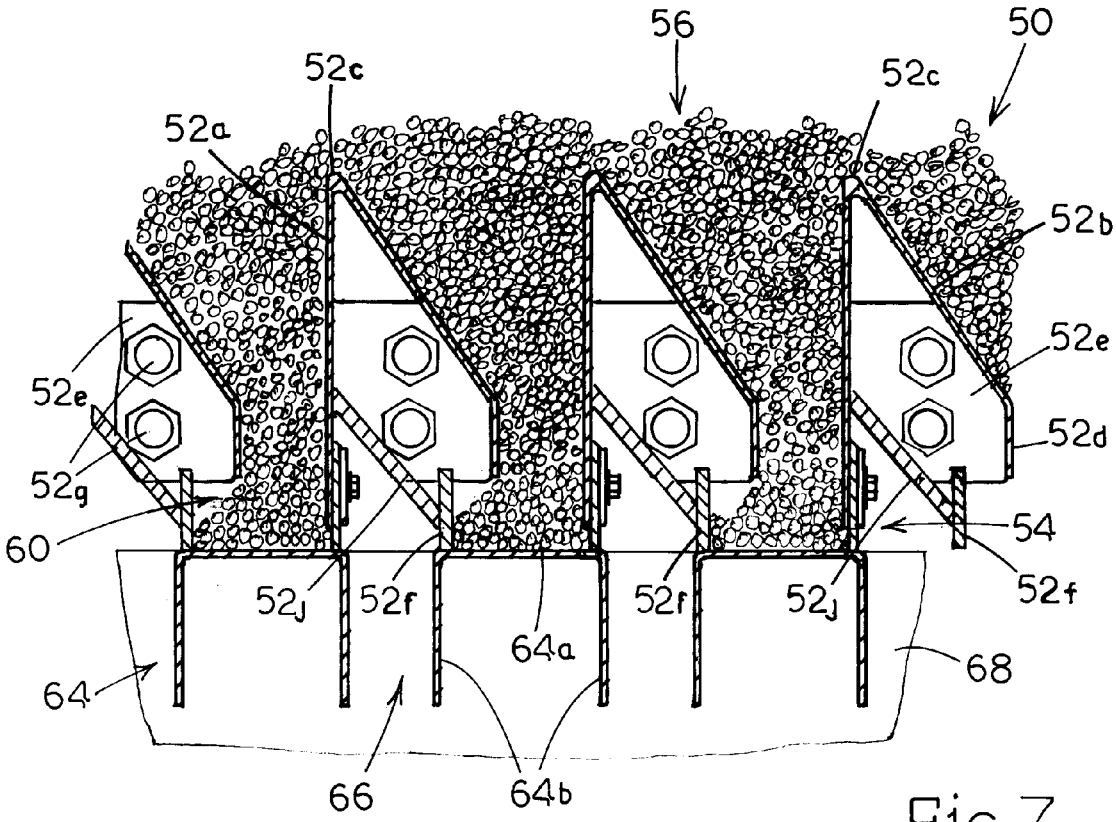
FIG. 7 is a fragmentary sectional view of the discharge assembly of the present invention showing the relative orientation of the baffle assembly and the reciprocating grate structure when in a low or no flow configuration.
Figure 8:
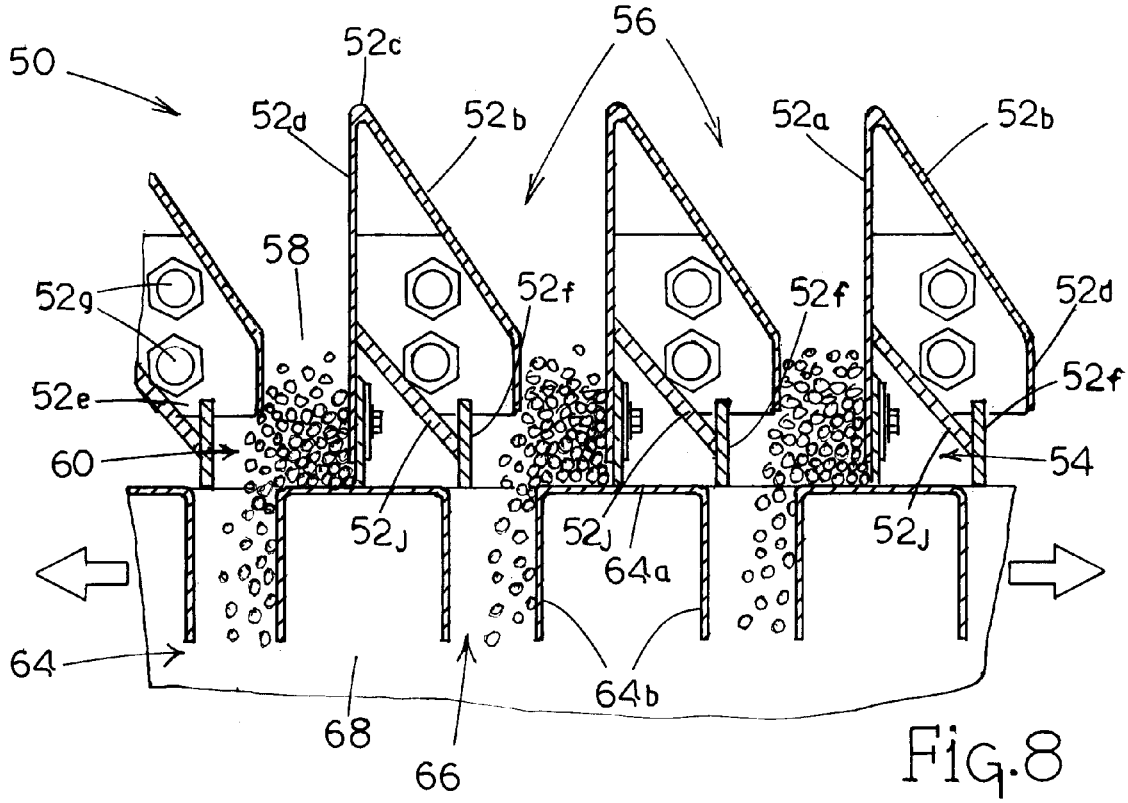
FIG. 8 is a fragmentary sectional view of the discharge assembly of the present invention showing the relative orientation of the baffle assembly and the reciprocating grate structure when in a flow configuration that yields a flow rate higher than the configuration of FIG. 7.
Figure 9:
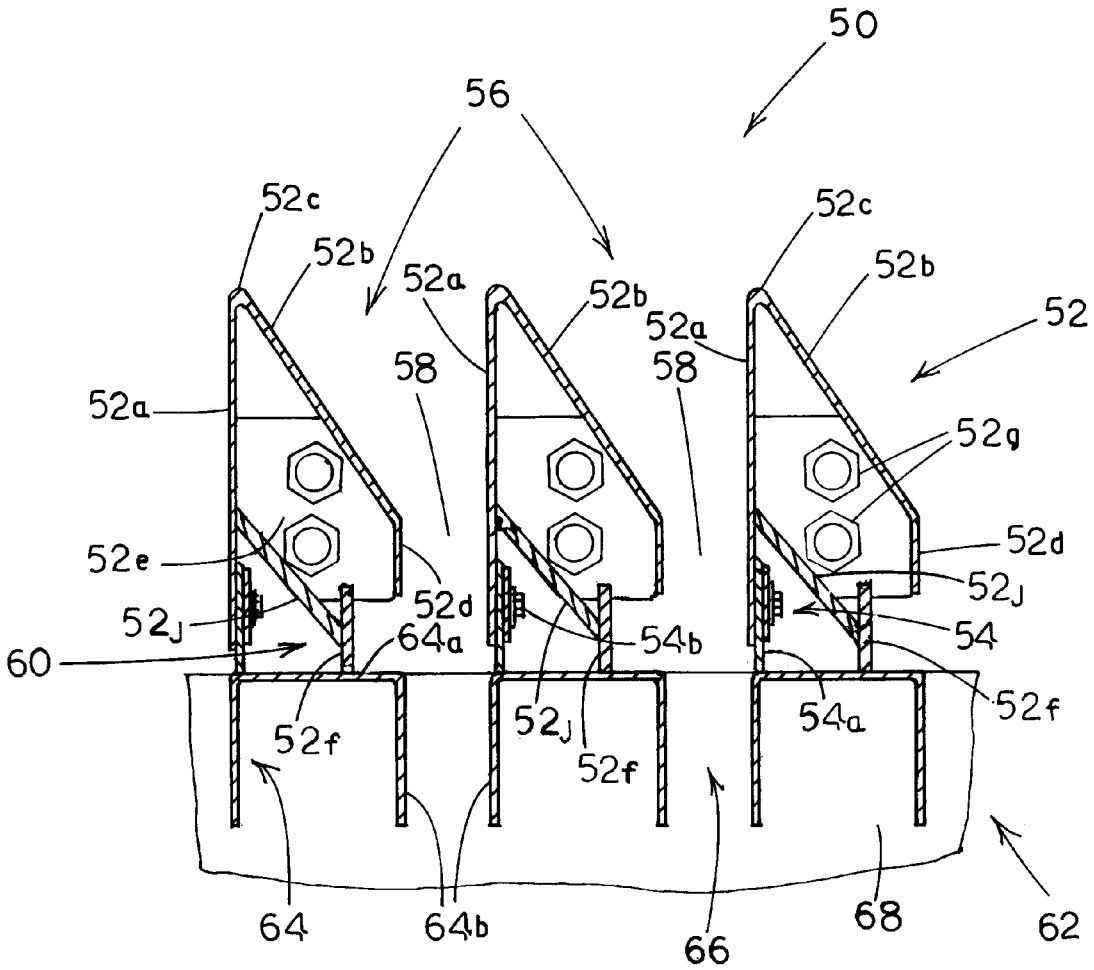
FIG. 9 is a fragmentary sectional view of the discharge assembly of the present invention showing the relative orientation of the baffle assembly and the reciprocating grate structure when in a maximum flow rate configuration, typical of a clean-out operation.

Disposed generally between the lower portion of the chamber 24 and the upper portion of the discharge hopper 30 is a discharge assembly, indicated generally by the numeral 50. Discharge assembly 50 comprises a stationary baffle assembly, generally indicated by the numeral 51 and a reciprocating grate assembly, indicated generally by the numeral 62. The stationary baffle assembly 51 is further comprised of an array or series of elongated baffles 52 which extend between and are secured to the side frame members 16, as illustrated in FIGS. 1*a*, 2, 7, 8 and 9. As shown in FIG. 9, each baffle 52 assumes a generally inverted "V" shape, and includes a long vertical wall section 52*a* in combination with an inclined wall section 52*b* such that an apex 52*c* is formed where the upper ends of the two wall sections intersect. Extending downwardly from the lower end of the inclined wall section 52*b* is a generally vertical, short wall section 52*d*. Disposed about the ends of each baffle 52 are end plates 52*e*, which contain a pair of bolt apertures (not shown). As previously mentioned, the elongated baffle 52 comprising the baffle assembly 51 are secured to the side frame members 16 via the end plates 52*e* and bolts 52*j*.

It should be appreciated that the various wall sections 52*a*, 52*b*, 52*d* and end plates 52*e* may be formed of a single continuous length of baffle material which is bent or molded into shape or, conversely, the baffle may be constructed of individual sections of material that are mechanically joined together to form the composite "V" shaped structure as described.

In addition, each baffle 52 includes an elongated stopper bar 52*f* that is suspended or supported by an inclined support structure 52*j* that extends generally downwardly and at an angle from the inside face of the wall section 52*a*. The stopper bars 52*f* extend the full width of the baffles 52 and assist in metering bulk material through the discharge assembly 50. As seen in FIGS. 7–9, the stopper bars 52*f* extend generally vertically and lie in a plane intermediately between the plane of wall 52*a* and wall 52*d* of each baffle 52. Note however that the stopper bars 52*f* extend downwardly to where their lower edges rest just above the reciprocating grate assembly 62.

Continuing with the discussion of the baffle structure 52, it can be seen in FIGS. 7–9 that the lower end of the long vertical wall section 52*a* is adapted to receive a wiper assembly, generally indicated by the numeral 54, via a bolt aperture (not shown). The wiper assembly 54 includes a wiper blade 54*a* which is secured to the wall section 52*a* via a bolt aperture (not shown) formed in the wiper blade 54*a* and a corresponding wiper bolt 54*b*. In practice, the wiper blade 54*a* is typically fabricated of an ultra high molecular weight polyethylene or polyurethane polymer, and the degree of downward extension of the wiper 54 from the wall section 52*a* can be adjusted via the wiper bolt mechanism previously described.

Turning now to the reciprocating grate assembly 62, which is located below and adjacent the baffle assembly 51 as shown in FIGS. 1, 1*a*, 7, 8 and 9, it can be seen from these drawings that the grate assembly 62 is comprised of an array or series of elongated, generally rectangular grate or slat members 64. While having a generally rectangular profile, the slat members 64 incorporated in the present embodiment of the invention actually contain three of the walls of a true rectangle. Each of the slat members 64 is oriented so as to form a single generally horizontal upper surface 64*a*, while also forming a pair of generally vertical side surfaces 64*b*which extend downwardly from and on either side of the upper surface 64*a*.

As mentioned previously, with regard to the construction of the baffles 52, it should be appreciated that the slat wall sections 64*a* and 64*b* may be formed of a single continuous length of slat material which is bent or molded into shape or, conversely, the slat member may be constructed of individual sections of slat material that are mechanically joined or welded together to form the semi-rectangular shaped slat structure as described above.

Figure 1A:
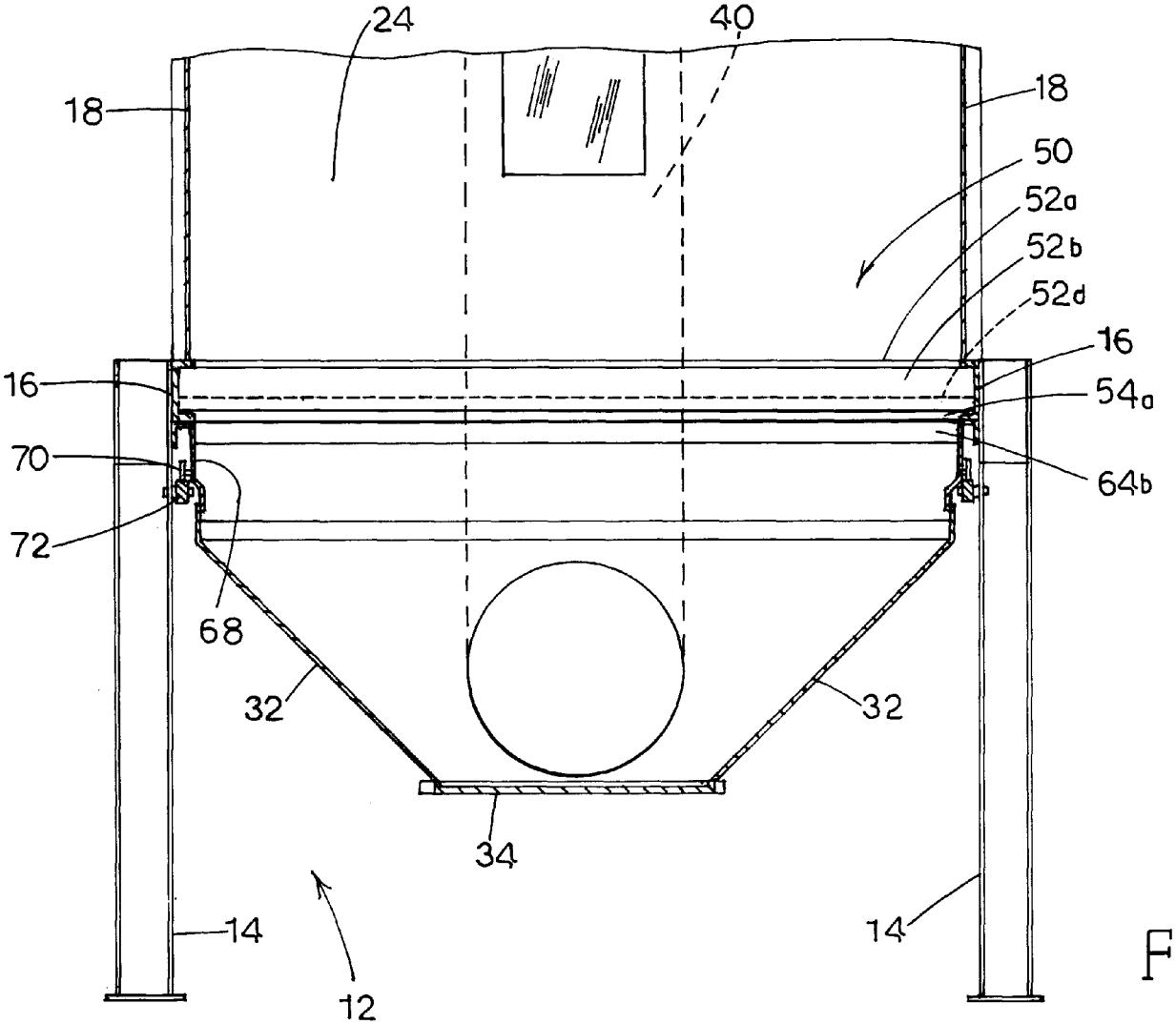
FIG. 1A is a sectional view taken through the line 1A–1A of FIG. 1.
Figure 2:
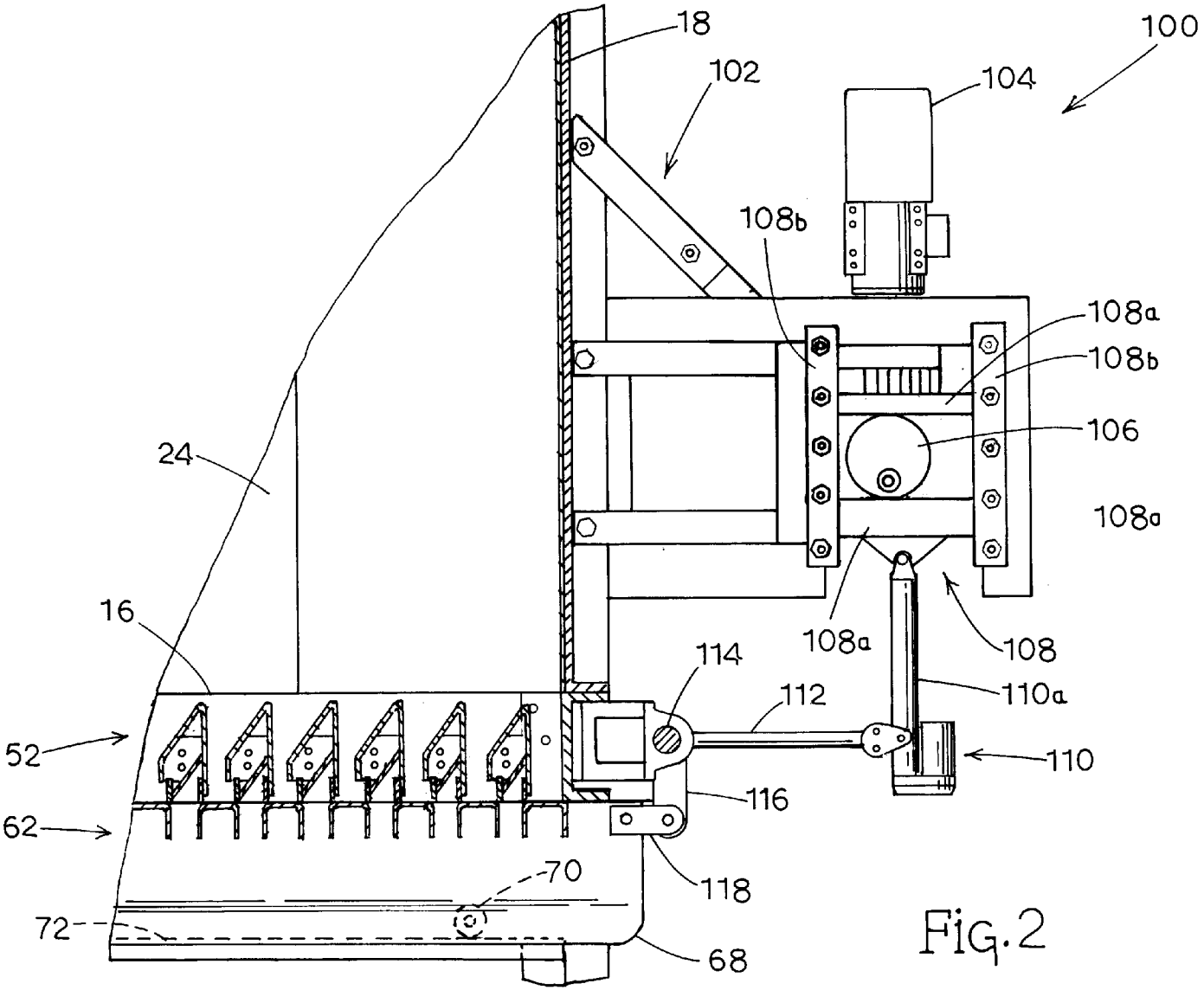
FIG. 2 is a partial sectional view of the discharge assembly of the present invention including the actuating assembly for the grate structure which is associated therewith.

The slats 64 as described above, are housed within a movable carrier frame 68, which is movably mounted on the mainframe 12 via a series of rollers 70 adapted to be received and maintained on a roller track 72 which is supported on the mainframe 12 (FIGS. 1A and 2). Being so positioned within the carrier frame 68, the slat members 64 in combination with the adjacent baffle assembly 51 form a number of areas or openings which are significant with regard to the operation of the overall discharge assembly 50, as illustrated in FIGS. 7–9. In particular, there is a series of flow-through areas, generally indicated by the numeral 56, which are formed between the long vertical wall section 52*a* of each baffle and the inclined wall section 52*b* of the adjacent or neighboring baffle. With regard to vertical expanse, this flow-through area 56 extends from the baffle apex 52*c* downward to the junction of the inclined wall section 52*b* and the short vertical wall section 52*d*. Formed immediately below and continuous with the flow-through area 56 is a relatively narrow throat area 58, which is formed between the long vertical wall section 52*a* of each baffle and the short vertical wall section 52*d* of the adjacent or neighboring baffle. Vertically, the baffle throat area 58 extends the length of the short vertical wall section 52*d*. Continuing downwards through the discharge assembly 50 is a wiper reservoir area 60, which extends generally downward from the lower edge of the short vertical wall section 52*d*, and is bounded on either side by the wipers 54, and from below by the upper surface 64*a* of a reciprocating slat member 64. It should be appreciated that during the course of normal operation, the wiper blades 54*a* will typically be adjusted, via the wiper bolts 54*b*, so as to extend downwardly from the long vertical wall section 52*a* of the baffle 52 into close proximity of or light contact with the upper surface 64*a* of the slat member 64. The so formed wiper reservoir area 60 is generally continuous with the baffle throat area 58 described above.

When positioned and secured within the movable carrier frame 68, the side surfaces 64*b* of the slat members 64 form a series of elongated openings or inter-slat passageways 66, as shown in FIGS. 5, 7–9, through which the bulk material is permitted to flow. The rate of material flow-through these inter-slat passageways 66, and consequently through the overall discharge assembly 50, is determined at any instant by the relative orientation of the upper baffle assembly 51 and the lower reciprocating grate assembly 62, while the long term or steady state material flow rate is determined by the reciprocation range (stroke) and frequency of the grate assembly 62.

FIGS. 7–9 illustrate the relative orientation of the baffle assembly 51 and the grate assembly 62 at several points within the reciprocation range that would typically be achieved during normal operation of the bulk cooler 10. For instance, FIG. 7 illustrates a minimal or substantially no flow rate configuration of the discharge assembly 50. As shown in the drawing, the reciprocating grate assembly 62 has assumed a position which places the upper surfaces 64*a* of the slat members 64 in direct alignment with the baffle throat area 58. Given this gross misalignment of baffle and grate flow pathways, very little if any bulk material will be permitted to pass through the interface between the baffle assembly 51 and grate assembly 62, hence the minimal flow configuration. Consequently, instead of flowing through the baffle-to-grate interface, the bulk material will tend to collect or be deposited in the wiper reservoir area 60 while being support on the underlying slat members 64, also clearly shown in FIG. 7. Indeed, the stopper bars 52*f* assures that there is substantially no flow or at least only a minimal flow in this configuration. Note that the stopper bars 52*f* assist in blocking the flow of bulk material through the baffle-to-grate interface.

FIG. 8 illustrates an intermediate or mid flow rate configuration of the discharge assembly 50. As clearly shown in the drawing, the reciprocating grate assembly 62 has assumed a position which places the inter-slat passageways 66 in at least partial alignment with the baffle throat area 58, thus providing a limited degree of direct communication or continuity between the baffle through flow areas and the grate flow paths. In the configuration of FIG. 8, it is seen that the stopper bars 52*f* now assume a position of alignment where they override the opening 66 that is formed between the respective slats 64. This obviously permits the flow of bulk material downwardly between the respective baffles and through the baffle-to-grate interface. As a result of this partial alignment of baffle and grate flow pathways, a moderate amount of bulk material will be permitted to pass through the interface between the baffle assembly 51 and grate assembly 62, hence the intermediate or mid rate flow configuration. Furthermore, it should be appreciated from FIGS. 7 and 8 that as the reciprocating grate assembly moves from the position shown in FIG. 7 to the position shown in FIG. 8, the wiper 54 effectively brushes or wipes the material which has accumulated in the wiper reservoir 60 across the upper surface 64*a* of the slat member 64 and into the inter-slat passageway 66. Thus, it is a combination of baffle throat 58 to inter-slat passageway 66 alignment and wiper reservoir 60 discharge that determines the flow of material through the baffle-to-grate interface and hence through the overall discharge assembly 50.

FIG. 9 illustrates the relative baffle-to-grate orientation associated with the discharge assembly 50 when the same assumes a clean-out position or configuration. The general goal of such a configuration is to facilitate the rapid and complete removal of all material from the chamber 24, and consequently the discharge assembly 50, itself. It can be clearly seen in the drawings that the baffle throat areas 58 and the inter-slat passageways 66 are completely aligned, thus providing the maximum possible continuous flow path through the baffle-to-grate interface. Furthermore, by comparing the configuration shown in FIG. 7 to that shown in FIG. 9, it can be seen that in transitioning between the minimal flow configuration and the clean-out configuration, the wipers 54 have swept the entire wiper reservoir 60 clear of material, and their final clean-out position generally prevents the accumulation of further material in the reservoir area 60.

As previously discussed, under normal operating conditions and in a preferred embodiment, the grate assembly 62 functions in an oscillating or reciprocating manner with respect to the adjacent baffle assembly 51. However, what is important is that there be relative reciprocal movement between the grate assembly 62 and the baffle assembly 51. This reciprocating action is accommodated by the rollers 70 which are attached to carrier frame 68 and the roller track 72 which is disposed about the mainframe structure 12. Actuation of the carrier frame 68 and the associated grate structure is facilitated by a grate actuating assembly, shown in FIG. 2 and indicated generally by the numeral 100. Actuating assembly 100 comprises a frame structure, generally indicated by the numeral 102, which supports an electric motor 104. Coupled to the drive shaft of the motor 104 is a right angle gear box (not shown). The output of this gear box is connected to an eccentric cam 106, which is disposed within the frame structure 102 so as to be coupled to a cam following mechanism, generally indicated by the numeral 108. This cam following mechanism 108 is further comprised of a pair of sliding plates 108*a* which are moveably mounted within a stationary vertical track assembly 108*b*. The sliding plates 108*a* are disposed about the cam 106 so as to effectively capture or sandwich the cam 106, and as such the plates 108*a* are adapted to slide up and down vertically within the track assembly 108*b* in a manner which follows the relative vertical displacement of the eccentric cam 106. Connected to the lower end of the cam following assembly 108 is an accumulator, generally indicated by the numeral 110 which further includes an accumulator linkage 110*a*. More specifically, the lower end of the cam following assembly 108 is coupled to the accumulator 110 via the upper end of the accumulator linkage 110*a*. The lower end of the accumulator linkage 110*a* is connected via a pivoting swing linkage 112 to a bearinged rock shaft 114. Rock shaft 114 is contained and confined within a housing that is mounted to the main frame 12, and furthermore the rock shaft 114 is rigidly connected to a vertical swing linkage 116. This vertical swing linkage 116 in turn makes connection to the carrier frame 68 via a pivoting horizontal connector linkage 118 (FIG. 2).

Under normal steady state operation, the accumulator linkage 110*a* is of a fixed length and is operative to reciprocate the grate structure 62 back-and-forth. However, because of the nature of the accumulator 110, the accumulator linkage 110*a* can be extended. As will be appreciated from subsequent portions of this disclosure, the accumulator 110 can be actuated to cause linkage 110*a* to be extended and when linkage 110*a* is extended, the grate structure 62 and the baffle assembly 52 are aligned such that the clean-out position or configuration, as shown in FIG. 9, is achieved.

Figure 10:
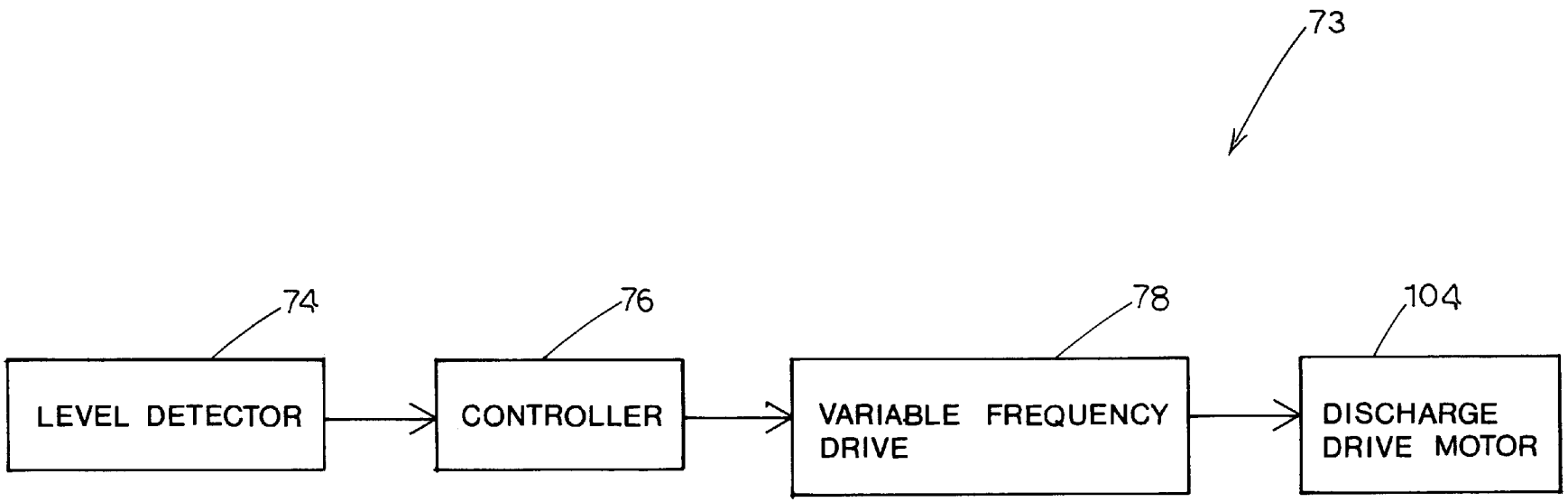
FIG. 10 is a simplified schematic diagram generally illustrating the functional operation of the bulk material flow rate control system of the present invention.

Normal operational control of the grate actuating assembly 100 described above is typically accomplished via the control loop or system schematically illustrated in FIG. 10 and generally indicated by the numeral 73. From the block diagram it can be appreciated that the primary sensory input to the control system 73 is with respect to the level of bulk material within the cooling chamber 24. Such bulk material level information is provided by a conventional level sensor 74 which is not discussed in detail herein, as it will be appreciated by those skilled in the art that such instrumentation systems are well known and commonly implemented in a variety of similar bulk material processing applications. The bulk material level information provided by the level sensor 74 is provided in an appropriate format to a controller 76 which processes the level information and ultimately issues control instructions to a variable frequency drive unit 78. This variable frequency drive unit is communicatively coupled to the discharge drive motor or actuator 104, and serves to directly control the rotational speed of the drive shaft of the motor and hence the reciprocation frequency of the grate assembly 62.

Figure 3:
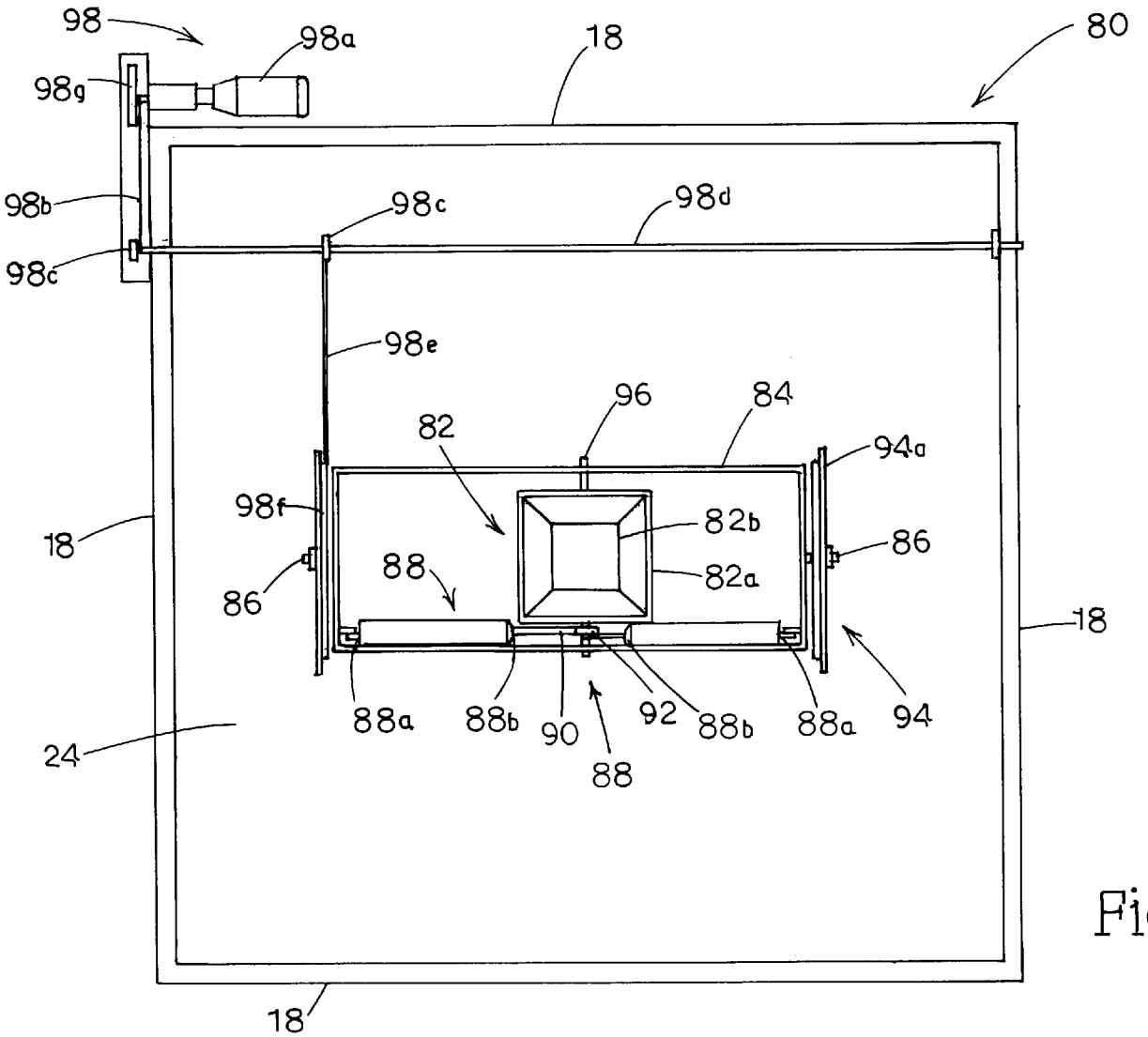
FIG. 3 is a top plan view of the spreader assembly of the present invention including the spout and cradle actuators associated therewith.
Figure 4:
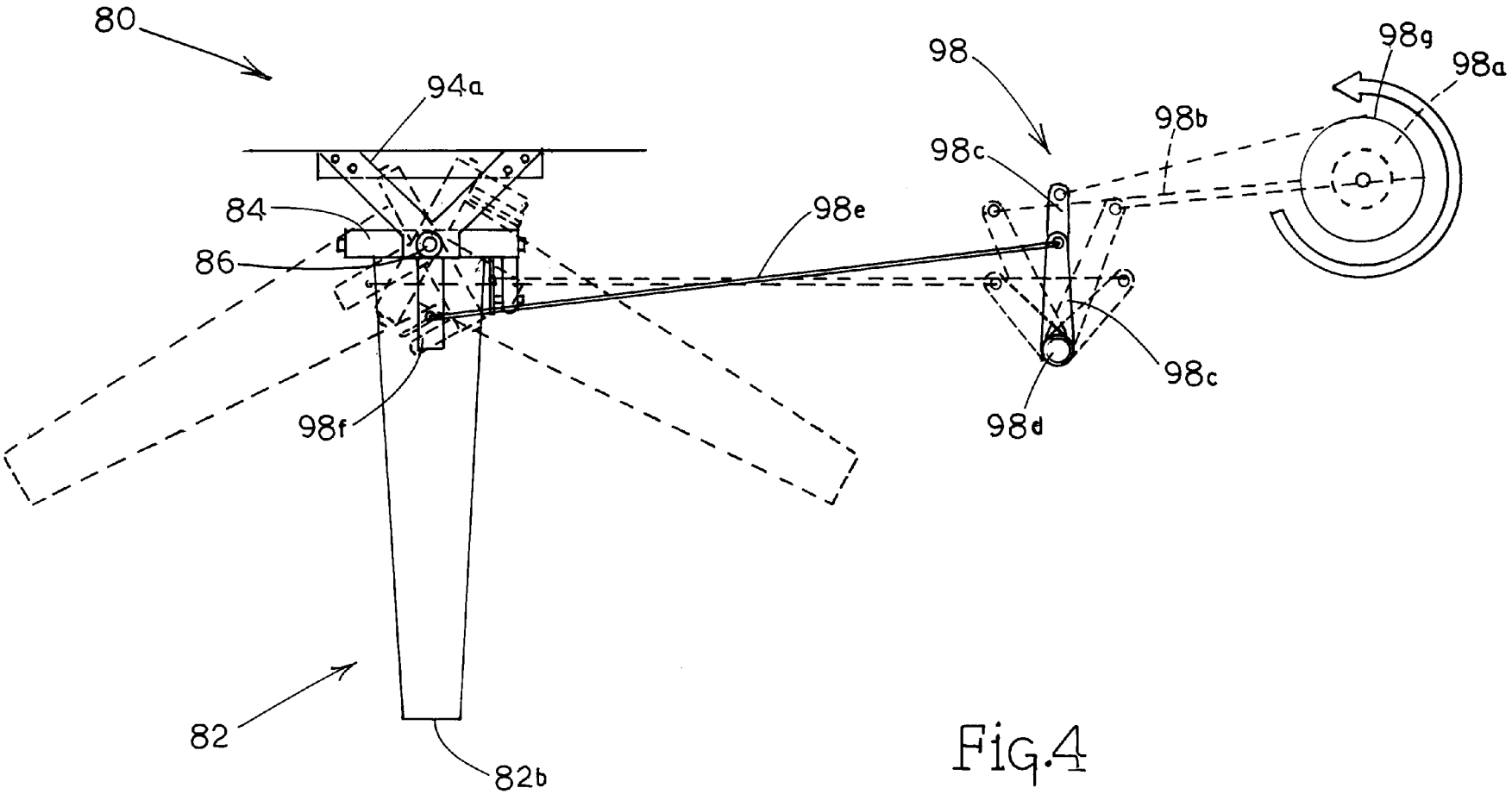
FIG. 4 is a side elevation view of the spreader assembly illustrating the range of motion induced in the spout by the cradle actuator.
Figure 5:
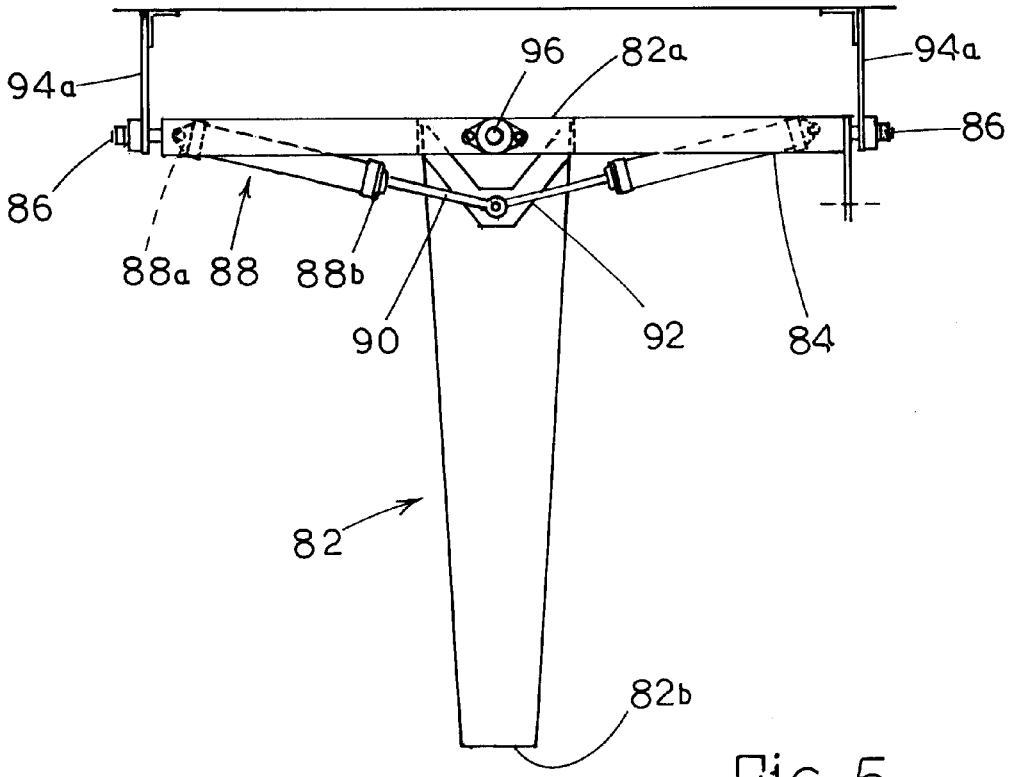
FIG. 5 is a side elevation view of the spreader assembly showing the relative positioning and orientation of the spout actuators.
Figure 6:
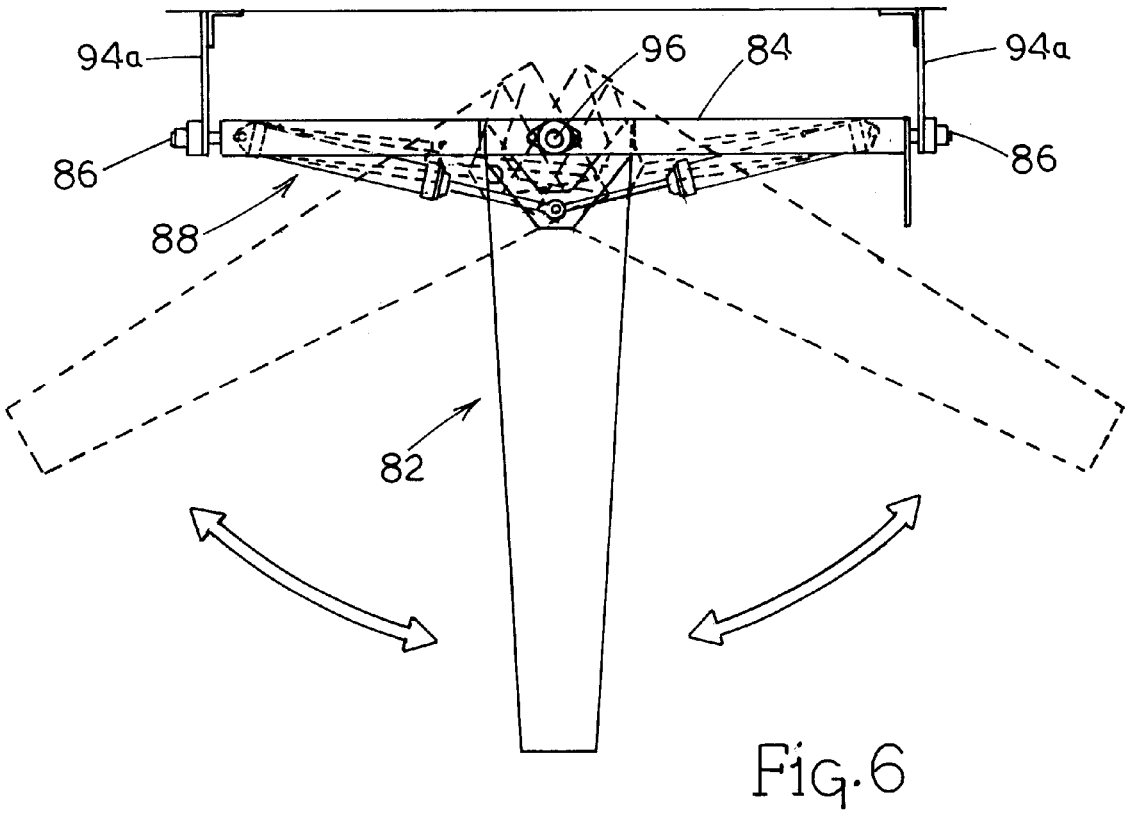
FIG. 6 is a side elevation view of the spreader assembly illustrating the range of motion induced in the spout by the spout actuator.

Turning now to FIGS. 1 and 3–6, illustrated in the drawings is a spreader assembly 80 which is adapted to be received or mounted in the top structure 20 of the bulk cooler 10. Positioned as such, the spreader assembly 80 is disposed so as to receive from the rotary air lock 44 a feed stream of bulk material that is to be cooled. The spreader assembly 80 comprises a tapered spout, indicated generally by the numeral 82, that includes a spout inlet 82*a* and spout outlet 82*b*. As shown in FIG. 3, the spout assembly is generally housed within a cradle 84 which is connected via a bearinged shaft 86 to a cradle frame assembly, indicated generally by the numeral 94, and which comprises a pair of side frame members 94*a* which are rigidly attached to and depend from the top structure 20. The tapered spout 82 is connected to the cradle 84 via a rock shaft 96. Rigidly connected to the inlet end of the spout 82 is a yoke 92, which is further connected to a pair of actuators, generally indicated by the numeral 88 via the rod 90 of the actuators. Actuators 88 are typically of a hydraulic or pneumatic cylinder and contain a base or anchored end 88*a* and a rod end 88*b*. As shown in FIG. 5, the rod 90 of the actuators 88 is connected to the yoke 92. Consequently, the actuation of the actuators 88, which are again typically double-acting hydraulic or pneumatic cylinders, results in the spout 82 being oscillated about its axis 96. Shown specifically in FIGS. 5 and 6 are views of the spreader assembly 80 which illustrate both the static components and the dynamic range of motion of the spout 82 under normal operating conditions.

Returning now to the cradle 84, FIG. 4 provides an illustration of a cradle actuating assembly, generally indicated by the numeral 98. Actuating assembly 98 comprises an electric motor 98*a* which is drivingly connected to a to a crank wheel 98*g*. The crank wheel 98*g* is in turn connected to a connecting link 98*b* that is operative to rotate a rock shaft 98*d* back and forth. In particular, the rock shaft 98*d* includes a pair of crank arms 98*c* secured thereto. Connecting link 98*b* extending from the crank wheel 98*g* is connected to an outside crank arm 98*c* as illustrated in FIG. 3. The intermediate crank arm 98*c* secured to rock shaft 98*d* is connected to a second connecting link 98*e* which in turn is connected to a yoke 98*f* that is rigidly connected to the cradle 84 and extends therefrom.

Turning now to a discussion of typical operation, it will be appreciated from the previous discussion and the associated drawings, particularly FIG. 1, that a flow of air through the chamber 24 is established in a direction generally proceeding from the inlet duct 40 and through the associated discharge hopper 30 located at the bottom of the chamber 24 to the exhaust ducts 42 located at the top of the chamber 24. Air flow is facilitated by application of a low pressure or vacuum source (not shown) to the exhaust ducts 42, in which case it is assumed that the pressure established and maintained at the exhaust ducts 42 is less than the pressure of the air entering the chamber 24 via the inlet duct 40. Furthermore, as previously mentioned, the temperature and moisture content of the air provided to the inlet duct 40 can be varied in such a manner so as to cause the overall apparatus 10 to perform either as a bulk material cooler or bulk material dryer. For the purpose of discussion to be presented below, it will continue to be assumed that the conditions of the inlet air stream are such that the apparatus 10 behaves as a bulk material cooler.

Given that the above described air flow conditions have been established, bulk material is permitted to flow-through the top 20 and down into the chamber 24 via rotary air lock 44. In general, the rotary air lock 44 is intended to provide a unidirectional flow path for the incoming bulk material such that the material is permitted to flow from an external material feed source into the chamber 24, and air is not allowed to enter through the rotary air lock 44. A detailed description of the functional design and operation of the rotary air lock 44 is not presented herein, as it will be appreciated that the design and operation of such rotary air locks are well understood by those skilled in the art, and furthermore, rotary air locks of the type contemplated by and incorporated in the cooling apparatus 10 of the present invention are commonly employed in similar bulk materials processing equipment.

As bulk material flows through the rotary air lock 44, the material is received by the spreader assembly 80. In particular, the material is received at the wide mouth or inlet 82*a* of the tapered spreader spout 82. The material generally flows through the spout 82 and is eventually discharged through the narrow mouth or outlet 82*b* of the spout into the confines of the chamber 24. In addition to simply receiving and passing the in-flowing material, the spreader assembly 80 also serves the very significant function of uniformly dispersing the in-flowing material within the chamber 24. This uniform dispersion function is effectively accomplished via the pair of spreader actuating assemblies 88 and 98. These actuators are responsible for causing movement of the spout outlet 82*b* from side-to-side across the width of the chamber 24, while simultaneously moving the spout outlet 82*b* from the front-to-back of the chamber 24. The effect of this composite motion is to cause the material flowing from the spout outlet 82*b* to enter the chamber 24 as an oscillating stream which, if viewed from a plane above the spreader assembly 80, assumes the general form of a phase shifting or non-repeating sinusoidal type wave. By phase shifting or non-repeating it is meant that as the stream of material is directed back-and-forth across the chamber 24, the resulting sinusoidal type wave that is observed does not follow the same path across the chamber 24 from one pass to the next. The phase of the wave or stream of material is shifted from one pass across the chamber 24 to the next, so no exact overlapping of material streams is permitted on any two consecutive passes or cycles. By moving the spout 82 in the manner described above, a considerably more uniform distribution of in-flowing material can be achieved within the chamber 24, which ultimately contributes to the highly efficient and effective operation of the bulk cooler 10.

With regard to the specifics of operation of the spreader assembly actuating mechanisms, the spout actuating assembly or fluid or pneumatic cylinders 88 when activated pulls and pushes the yoke 92 with respect to the cradle 84. As the yoke 92 is rigidly attached to the spout 82 and the spout is further pivotally attached to the cradle 84 via the rock shaft 96, the resulting motion of the yoke 92 translates into a rocking or back-and-forth motion of the entire spout 82 within the confines of the cradle 84 as shown in FIG. 6. Simultaneously, the cradle 84 which is pivotally attached to the top 20 via the cradle frame 94 and the bearinged shaft 86, is also induced into motion by the cradle actuator assembly 98 (FIG. 4). It will be appreciated from FIGS. 3–6 that the axes of rotation induced in the spreader assembly by these two actuators 88 and 98 are generally orthogonal, that is 90 degrees apart. With regard to the cradle actuating assembly 98, FIG. 4 clearly illustrates the range of motion induced in the spout 82 by the actuating motor 98*a*. As the connecting link 98*b* is moved back-and-forth via the wheel crank 98*g*, the outside lever arm 98*c* is rocked back-and-forth on the rock shaft 98*d*. As illustrated in FIGS. 3 and 4, as the rock shaft 98*b* is rocked back- and-forth by the outside lever arm 98*c*, the inside lever arm 98*c* is also moved back-and-forth and because of its connection with the second connecting link 98*e*, the yoke 98*f* is rocked back-and-forth causing the entire cradle 84 to be rotated about the opposed stub shafts 86. Consequently, it follows that as the electric motor 98*a* is driven, the cradle 84 is rocked back-and-forth. With regard to the combined action of the two actuators 88 and 98 described above, it will be appreciated that a non-repeating, generally sinusoidal type flow pattern can be achieved if the individual actuators rock their respective linkages at frequencies that are neither equal nor even multiples of one another. Such synchronized action of the spreader assembly actuators 88 and 98 results in the uniform distribution of in-flowing material within the chamber 24 as described previously above.

As the in-flowing bulk material is uniformly spread into the chamber 24 by the spreader assembly 80, it falls downwardly through the chamber 24 in a direction that is generally counter to the direction of the cooling air flow. During this fall, heat is convected away from the material through contact with the cooling air stream. In general, the temperature of the cooling air stream will rise as it flows upwards through the chamber 24 and contacts the hot or warm bulk material that is being issued from the spreader assembly 80. Conversely and consequently, the average temperature of the bulk material will tend to decrease as the material falls from the outlet of the spreader spout 82*b* towards the discharge assembly 50 located at the bottom of the chamber 24 as a result of this convective transfer of heat to the cooling air stream. For example, during the cooling of bulk granular animal feed, the temperature of the in-flowing material stream will typically range from 120 to 200 degrees Fahrenheit, and the convective heat transfer that occurs in the chamber will reduce the temperature of the bulk material to approximately 10 or 15 degrees Fahrenheit above the ambient air temperature by the time the material reaches the discharge hopper outlet.

At some point the free falling material will strike the discharge assembly 50, which effectively controls the rate of discharge of material from the chamber 24 and also forms the working floor or lower boundary of the chamber 24. Upon reaching the discharge assembly 50, the material will first encounter the stationary or fixed baffle assembly 51, as generally illustrated in FIGS. 7 and 8. While the baffle assembly 51 is actually comprised of a number of baffles 52, in the following discussion, the operational mechanics of just a single pair of baffles will be considered, as the basic description and theory of operation can be extended to any number of so configured baffles. In general, the in-flowing material will enter the flow-through area 56 formed between any two adjacent baffles 52, where the material will be collected and effectively funneled into the adjacently disposed throat area 58. It will be appreciated from the associated drawings that the throat area 58 serves as the entry point for material passing therethrough and into the wiper reservoir 60 below. Therefore, as shown in FIG. 7, when the wiper reservoir 60 becomes filled to capacity, the throat area 58 will serve to collect and hold material just above the wiper reservoir 60 such that as the reservoir empties, via the action of the reciprocating grate assembly 62, the reservoir will be rapidly and efficiently refilled thus contributing to the smooth and uniform discharging action of the overall assembly 50. As mentioned previously, the reciprocating nature of the grate assembly 62 actually initiates and terminates the flow of material through the discharge assembly 50. As shown in FIG. 7, the top surface 64*a* of the slat members 64, and consequently the associated inter-slat passageway 66, are so aligned with the adjacent baffle assembly 51 as to introduce sufficient discontinuity in the flow path between the throat area 58 and the inter-slat passageway 66 to effectively stop or minimize the flow of material therethrough. In this case, it will be appreciated that the wiper assembly 54 associated with each baffle 52 serves to prevent the unwanted flow of material from the reservoir 60 into and through the adjacent or neighboring inter-slat passageway 66.

As the reciprocating grate assembly 62 moves towards a more open configuration as shown in FIG. 8, the slat members 64 are moved laterally relative to the stationary baffle assembly 51. As slat members 64 move laterally, the wiper assembly 54 is disposed so as to effectively sweep or wipe the reservoir material, which is located above the slat upper surfaces 64*a*, into and through the associated inter-slat passageways 66. Furthermore, as the throat area 58 and the inter-slat passageway 66 are brought into alignment, at least partially, the flow of material is permitted from the throat areas and associated flow-through areas 56 directly through the adjacent passageways 66. Upon passing through the inter-slat passageway 66, the material is generally collected within the discharge hopper 30 and ultimately delivered through the outlet 34 to an awaiting bulk material receptacle or conveyor (not shown).

It will be appreciated, as shown in FIG. 9, that the reciprocating grate assembly 62 may also be configured so as to facilitate complete or nearly complete alignment of the baffle throat areas 58 and the inter-slat passageways 66. Under such conditions, the wiper assemblies 54 will have swept clean the reservoir areas 60 above the slat upper surfaces 64*a*, and the direct alignment of the throat areas 58 and passageways 66 will insure a maximum possible flow rate of material through the discharge assembly 50. Such a configuration is typically associated with the cleaning or emptying of the chamber 24 and is referred to as the clean-out configuration.

As mentioned in the preceding discussion, it is the reciprocating nature of the grate assembly 62 which facilitates the passage of material through the discharge assembly 50. Shown in FIG. 2 is the grate actuating mechanism 100 responsible for generating this relative reciprocating motion between the grate and baffle assemblies 62 and 51, respectively. In general, the motor 104 induces rotation of a vertically oriented eccentric cam 106 via a right angle gear box (not shown), which serves as an interface between the motor shaft and the cam 106. As the cam 106 rotates, the cam following mechanism 108 is slid up and down on the stationary vertical track 108*a*. As the accumulator 110 is connected to the lower end of the cam following mechanism 108 via the linkage 110*a*, the up and down motion of the mechanism 108 is communicated to accumulator 110 and consequently to the accumulator end of the associated swing linkage 112. As the accumulator end of the swing linkage 112 is moved up and down vertically, the remaining end of the linkage 112, being rigidly attached to the bearinged rock shaft 114, causes the shaft to rotate about it's central longitudinal axis. Consequently, the vertical swing linkage 116, which is also rigidly attached to the bearinged rock shaft, is made to rotate with said shaft, such that motion of the distal end on the linkage 116 defines an arc. Finally, the arc-like motion of the swing linkage 116 is conveyed to the grate assembly 62 and translated into a generally horizontal motion via the horizontal link 118 which is pivotally connected to both the swing linkage 116 and the grate assembly carrier frame 68. Thus, the generally rotary action of the motor 104 is effectively translated, via the sequence of shafts and linkages described above, to a reciprocating horizontal motion that drives the grate assembly 62 back-and-forth on the rollers 70 which are adapted to ride within a track 72 disposed about the mainframe 12. Under one set of normal operating conditions, the stroke length or range of relative displacement of the baffle and grate assemblies 51 and 62, respectively, typically ranges from approximately 0.5 to 1.5 inches, with a generally preferred value of approximately 1.0 inches.

It will be appreciated that it is the function of the accumulator 110 described above to provide the capability to manually adjust the effective length of the linkage 110*a*. Such a function is desirable in terms of discharge assembly calibration, that is to set or establish the normal operating range of relative positions attainable between the baffle and grate assemblies 51 and 62, respectively. Furthermore, the accumulator 110 also permits the baffle and grate assemblies 51 and 62, respectively to be oriented in the clean-out configuration as described above and generally illustrated in FIG. 9.

As previously discussed, the reciprocating action of the grate assembly 62 is responsible for regulating the flow of material through the discharge assembly 50. Thus, it follows that control of this reciprocating action will ultimately control the rate at which material is discharged from the chamber 24. This control function is served by the system 73 functionally illustrated in FIG. 10. It will be appreciated that after steady state operating conditions are achieved, incoming material will tend to temporarily accumulate within the chamber 24. This level of bulk material within the chamber 24 is monitored by level sensor 74 and information gathered by this sensor 74 is fed as input to a process controller 76. The process controller 76 in turn responds in a predetermined or pre-programmed fashion to the input level data by ultimately adjusting the speed of the motor 104 via the variable frequency motor drive unit 78. As will be appreciated from the preceding discussion of the grate actuating assembly 100, variation in motor speed will necessarily result in variation of the reciprocation rate of the grate assembly 62, and hence of the material flow rate therethrough.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. An apparatus for cooling or drying granular material comprising: a holding area for holding granular material; a discharge assembly disposed adjacent a bottom portion of a holding area; and wherein the discharge assembly includes a series of spaced apart generally inverted V-shaped baffles that define a series of flow-through areas between the respective baffles, and an open grate structure disposed below the baffles and wherein there is provided relative reciprocating movement between the baffles and the grate structure so as to meter the flow of material down through the flow-through areas defined between the inverted v-shaped baffles.

2. The apparatus of claim 1 wherein the grate structure includes an upper surface that catches at least some of the material passing between the baffles and wherein the baffles effectively sweep some of the accumulated material from the surface of the grate structure.

3. The apparatus of claim 2 wherein the baffle includes a lower edge portion that extends downwardly and terminates adjacent the surface of the grate and wherein the lower edge is effective to sweep material from the surface of the grate in response to the relative reciprocating movement between the baffles and the grate structure.

4. The apparatus of claim 1 wherein the grate structure is movable back and forth relative to the baffles and includes a series of laterally spaced members having openings therebetween, and wherein the individual members of the grate are movable back and forth between a first position where they are at least partially aligned with the flow-through areas between the baffles and a second offset position that allows material to flow down through the flow-through areas between the baffles and through the openings between the spaced apart members of the grate.

5. The apparatus of claim 3 wherein respective baffles include a wiper disposed about a lower portion thereof for engaging material overlying the grate and sweeping the material to one side in response to the relative reciprocal movement between the baffles and the grate structure, causing the material to fall downwardly through one or more openings formed in the grate structure.

6. The apparatus of claim 5 wherein the wiper is formed of a high molecular weight polymer material.

7. The apparatus of claim 1 wherein the respective baffles include a generally vertical side wall and an angled side wall.

8. The apparatus of claim 7 wherein the vertical and angled side walls join to form an apex.

9. The apparatus of claim 7 wherein the respective baffles include a second generally vertically extending side wall that extends downwardly from the angled side wall.

10. The apparatus of claim 7 including a wiper secured to a lower portion of the generally vertical side wall and wherein the wiper acts to engage material overlying the grate structure and to sweep material from the grate structure in response to there being relative reciprocal movement between the baffles and the grate structure.

11. The apparatus of claim 1 wherein each flow-through area defined between the baffles are bounded in part at least by an inclined wall forming a part of one baffle and a generally vertical wall forming a part of an adjacent baffle.

12. The apparatus of claim 11 wherein the grate structure is movably mounted for back and forth movement and includes a series of spaced apart members having openings formed therebetween, and wherein the grate structure is movable between a first position generally underlying the flow-through areas and an offset position where at least a portion of the flow-through areas generally aligns with the openings between the spaced apart members of the grate structure such that material can flow through the baffles and on through the grate structure.

13. The apparatus of claim 1 wherein the grate structure includes a series of laterally spaced members having openings formed therebetween and is reciprocal back and forth between at least two positions during a normal discharge operation, and wherein the grate structure is movable to a third clean out position where the openings between the members of the grate are generally aligned with the flow-through areas between the baffles so as to permit a cleaning out of material from the apparatus.

14. The apparatus of claim 1 including an actuator operatively connected to the grate structure for reciprocating the same.

15. The apparatus of claim 14 wherein the actuator includes an electric motor for driving the grate structure and wherein there is provided a control system for controlling the speed of the electric motor which in turn controls the speed of the reciprocating movement of the grate structure so as to ultimately control the discharge rate of material passing through the discharge assembly.

16. The apparatus of claim 15 wherein the control system includes a level detection device for sensing the level of material within the apparatus and wherein the level detection device is operatively connected to a variable frequency drive that is operative to vary the speed of the electric motor relative to the level of material disposed within the apparatus.

17. The apparatus of claim 1 including a two-dimensional spreader for generally uniformly feeding and spreading material into the holding area of the apparatus.

18. The apparatus of claim 17 wherein the spreader includes a spout movably mounted within a cradle about a first axis, and wherein the cradle is movably mounted to the apparatus about a second axis that extends generally normal with respect to the first axis such that material directed into the spout can be uniformly spread into the holding area of the apparatus by the spout swinging back and forth about the first axis within the cradle while the cradle itself is swung back and forth about the second axis.

19. The apparatus of claim 1 including a stopper for retaining granular material during at least some phase of the discharge operation.

20. The apparatus of claim 19 wherein the stopper is disposed such that it acts to laterally retain a portion of the granular material flowing between the baffle and the grate structure during at least some phase of the discharge operation.

21. The apparatus of claim 20 wherein the grate structure includes a top surface and wherein the stopper is generally vertically disposed and includes a lower edge disposed adjacent the top surface of the grate structure.

22. The apparatus of claim 3 wherein the baffle includes a stopper that extends in general parallel relationship with the lower edge portion of the baffle and wherein the stopper and lower edge portion of the baffle are laterally spaced apart.

23. The apparatus of claim 22 wherein the baffle includes opposite sides and wherein the stopper is disposed intermediately between the opposite sides of the baffle.

24. A counterflow vertical cooling or drying apparatus for cooling or drying granular material comprising:

a) a holding chamber for receiving and holding material;

b) an air inlet and air outlet associated with the apparatus for permitting air to be moved through the holding chamber;

c) a discharge assembly disposed adjacent a lower portion of the holding chamber for continuously discharging material from the holding chamber, the discharge assembly including:

i) a series of spaced apart baffles secured within the apparatus with the respective spaced apart baffles defining a series of material flow-through areas between the baffles;

ii) a reciprocating grate structure disposed below the baffles and including a series of spaced apart members that define a series of openings within the grate structure; and iii) an actuator operatively connected to the grate structure for reciprocating the same back and forth causing material to continuously flow downwardly between the baffles and through the flow-through areas and between the members that make up the grate structure.

25. The counterflow cooling or drying apparatus of claim 24 wherein the baffles are normally fixed relative to the grate structure and wherein the actuator is operative to reciprocate the grate structure from a first position where the members of the grate structure generally align with the flow-through areas defined by the baffles and a second position where the openings formed between the members of the grate structure are at least partially aligned with the flow-through areas such that material contained within the chamber can move downwardly through the flow-through areas and on through the openings formed in the grate structure.

26. The counterflow cooling or drying apparatus of claim 25 wherein the actuator is further operative to move the grate structure to a third clean out position where the openings formed between the members of the grate structure are generally aligned with the flow-through areas such that substantially all of the material contained within the chamber can be discharged therefrom through the flow-through areas and through the openings within the grate structure so as to effectively clean out the chamber.

27. The counterflow cooling and drying apparatus of claim 24 wherein the baffles include a series of wipers that extend therefrom and act to wipe away material accumulated on the grate structure as the grate structure is reciprocated back and forth underneath the baffles.

28. The counterflow cooling and drying apparatus of claim 27 wherein the wipers are constructed of a high molecular weight polymer material.

29. The counterflow cooling and drying apparatus of claim 24 wherein the respective baffles assume a generally inverted v-shape and include one generally vertical side wall and a second angled wall.

30. The counterflow cooling and drying apparatus of claim 29 wherein there is provided an attaching structure for securing the respective baffles to the apparatus and wherein the attaching structure enables the position of the respective baffles to be adjusted with respect to the grate structure.

31. The apparatus of claim 24 wherein the baffles include a series of stoppers disposed adjacent the grate structure for retaining a portion of the granular material and preventing the portion of granular material from passing through the openings within the grate structure during at least some phase of the discharge operation.

32. The apparatus of claim 31 wherein the respective stoppers move back and forth across a respective opening formed in the grate structure and wherein the respective stoppers assume one position where the stoppers are positioned over an outer edge of a respective member of the grate structure so as to prevent granular material from flowing past the outer edge and downwardly through an adjacent opening formed within the grate structure.

33. The apparatus of claim 32 wherein the baffles include opposite sides and wherein the stoppers are disposed intermediately between the opposite sides of the baffles.

* * * * *